United States Patent [19]

Williams

[11] Patent Number: 5,010,791

[45] Date of Patent: Apr. 30, 1991

[54] SHINGLE PRY BAR

[76] Inventor: James D. Williams, R.F.D 4, Thornwood Rd., Carmel, N.Y. 10512

[21] Appl. No.: 556,909

[22] Filed: Jul. 23, 1990

[51] Int. Cl.[5] ..... E04D 15/00

[52] U.S. Cl. ..... 81/45; 81/46

[58] Field of Search ..... 81/45, 46; 7/166, 170

[56] References Cited

U.S. PATENT DOCUMENTS

| | | | |
|---|---|---|---|
| D137,738 | 4/1944 | Bradley | 81/45 |
| 768,009 | 8/1904 | Boulter | 81/45 |
| 1,218,145 | 3/1917 | Whittier | 81/45 |
| 3,987,827 | 10/1976 | Mills | 81/45 |
| 4,009,743 | 3/1977 | Ackerman | 81/45 |
| 4,663,995 | 5/1987 | Amundson et al. | 81/45 |

*Primary Examiner*—Frederick R. Schmidt
*Assistant Examiner*—Lawrence Cruz
*Attorney, Agent, or Firm*—Frishauf, Holtz, Goodman & Woodward

[57] ABSTRACT

A prying blade (42) having an essentially triangular forward portion (43) is secured to a pipe handle (41) at an angle (D) of between about 20°-25°. The triangular forward portion is formed with a rounded or blunt apex region (47) and the two lateral sides (45*a*, 45*b*) have notches (44) therein, leaving teeth therebetween. The notches can engage nails for prying up roofing nails together with roofing shingles. The rear portion of the blade (49) is secured to the handle at a point rearwardly of the apex region, for example by welding, to form with the handle a triangular structure. The prying regions of the blades are thus securely supported. The triangular arrangement permits placement of the apex region of the prying bar between nails and removal by the notches in the sides (45*a*, 45*b*), or direct prying by the prying bar of a nail caught at the apex region.

16 Claims, 2 Drawing Sheets

SHINGLE PRY BAR

FIELD OF THE INVENTION

The present invention relates to a pry bar for roofing shingles and more particularly to a pry bar to remove one, and especially two or more superposed layers of shingles from a shingled roof, preparatory to re-shingling the roof with a new layer of shingles.

BACKGROUND

Roof structures for frame houses, particularly roofs which have a wooden roofing surface are covered, usually, with a plurality of layers. The outer layers are formed by roofing shingles which are somewhat flexible and are formed with projecting separated flaps, overlying, horizontally staggered, a lower course of shingles. Each portion of the roofing surface, typically of wood or a wood product, thus is covered by a plurality of layers, formed, initially, by roofing felt or roofing paper, and then by a first layer of shingles. If the roof was re-shingled, a second layer of shingles is placed over the solid portion of the first shingles and over their flaps. The very first or edge course of the shingles usually has another starting strip therebeneath so that the gaps between the flaps of the first course are also covered.

When the shingles deteriorate, that is, when the surface granulation thereof has worn off, or if the roof becomes damaged due to storms, or for other causes, it is customary to reroof the house by placing another or second layer of shingles, over the old shingles. When that, second roofing layer becomes worn or damaged, it is usually not possible to add a third layer thereover, since the strength of the roofing structure may not be able to support the weight of yet another layer of roofing shingles. Thus, it is necessary to remove the shingles which are already on the roof, that is, usually two layers of shingles.

The shingles are nailed on the roof, usually with roofing nails which have wide flat heads, so that they can securely hold the soft shingle material. The nails are not visible, nor are they exposed to weather. The nails are placed along the upper edge portion of the shingles of any one course, so that, when the next course of shingles is laid thereover, they will be hidden under the flaps of the succeeding shingles. Since these shingles, again, are nailed and held down in the same manner, it is not possible to merely raise any one flap of a shingle in order to obtain access to the nails. The flaps frequently hide them and the succeeding layer of flaps—in an upward direction—tend to hold down the preceding ones. This hold-down effect is a substantial safety feature maintaining the integrity of the roof under stormy conditions. To remove the shingles, problems arise in obtaining access to the nails. One can work, of course, from the top down, that is, in reverse order from shingling the roof. Yet, to obtain access to the nails, and to pry them up on a nail-by-nail basis if two layers of shingles are on the roof is extremely time consuming and not customary in the field. Pry bars with extending blades have been proposed, arranged to fit beneath layers of shingles, or between the roof and the layer of shingles so that hopefully, a group of nails could be pried up from the roof boards at one time. The pry bars, however, have a limited life and tend to deform or break.

THE INVENTION

It is an object to provide a shingling pry bar which is sturdy, capable of prying up a plurality of nails holding shingles, even though the nails may not be placed in a clearly defined repetitive nailing pattern, and which permits rapid working with less effort than with prior art tools.

Briefly, a roofing shingle removing tool, for short, a pry bar, is provided which has an elongated handle and, in accordance with the feature of the invention, a substantially flat prying blade which has an essentially flat triangular forward portion, converging towards an apex which, preferably, is rounded. The triangular forward portion has nail receiving notches formed at the apex and at the sides, leaving teeth between the notches. The forward portion extends to a rear support portion. The forward portion and the rear support portion are angled with respect to each other. A handle is secured, for example, by welding, to the prying blade in such a manner that the front end of the handle comes close to and preferably almost up to the rounded, notched apex of the triangular forward portion. The rear support portion, then, is attached to the handle, for example by welding, at a suitable position.

In accordance with the feature of the invention, the angle between the handle and the forward portion, which arises due to the angled off position of the rear portion of the prying blade is selected to define, with the handle, a triangle having a height h of about the length of a customarily used nail, i.e. about 2½ inches; a preferred angle is between about 22 to 23 degrees. The angle is not critical; an angle over 30 degrees, however, is too much, since the pry bar tool then becomes difficult to handle. If the angle is much less than 20 degrees, the tool becomes less suitable because it is difficult to pull nails which are used in multiple shingling out from the underlying roof structure, which, usually, is made of wood.

An angle of about 20°–25° provides for a heel or rear region of the forward portion of the prying blade which is spaced from the handle by a sufficient distance or height to permit application of a substantial leverage force on embedded nails to pry them up from the underlying roof structure. With a reasonable dimension of the prying plate, for example of a length of the forward portion from the apex towards the handle of about 7½ inches, the heel of the prying blade will then have a height h of about 2½ inches below the handle. Thus, tipping the tool from a position in which the blade can slide between the roof structure and the shingles, with the handle elevated, and then tipping the handle downwardly towards the surface of the roof, raises the tip and forward region or section of the triangular portion of the prying blade by about the dimension of the usually used roofing nails. If the roofing nails should be longer, which is unusual, the angle can be made slightly greater, or the prying bar blade longer; for most uses, however, the above dimensions are suitable.

The tool has the advantage over prior art structures that the attachment of the prying blade to the handle, due to its triangular form, can be close to where nails are to be gripped. This permits nails to be gripped at the point of attachment of the handle, or behind the point of attachment of the handle, and where the blade is securely supported by the rear support portion, rather than at extended projecting regions of a flat sheet metal element which, after multiple prying, has a tendency to deform, bend, or to break. Additionally, the essentially triangular forward portion permits random engagement between shingles in a region where an experienced roofer expects the nails to be, without, however, requiring alignment, by feel, of specific notches with nails which the roofer cannot see. If a nail is gripped which is laterally of the handle, the notches at the sides of the blade will engage the nail. The portion of the blade engaging such nails is supported at the apex and by the rear support portion. In a flat prior art horizontal blade, a laterally offset nail cannot be removed by the unsupported projecting part of the blade unless the tool is tilted or twisted sideways, which is difficult to do because of the superimposed layers of shingles and tends to damage the tool.

DRAWINGS

FIG. 1*a* is a plan view of a customary shingle removal tool in accordance with the prior art;

FIG. 1*b* is a side view of the tool of the prior art;

FIG. 2*a* is a top plan view of the tool of the present invention;

FIG. 2*b* is the side view thereof;

Figure 1A:
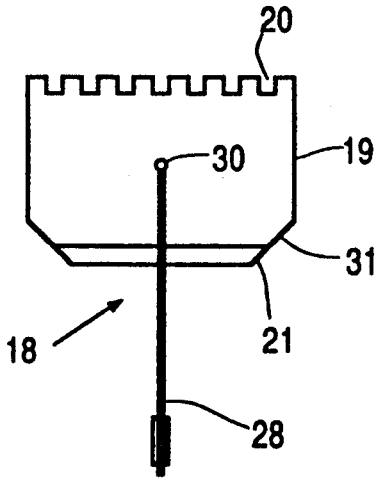
Figure 1B:
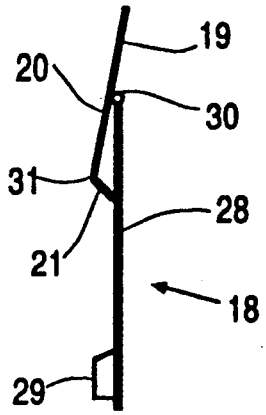

To remove, from a roof 10, with felt 11 thereover, and layers of shingles 12, 13, 22, 23, and subsequent courses up the roof, it has been customary to use a roofing tool 18, as shown schematically in FIGS. 1*a* and 1*b*. The tool 18 has a flat prying blade 19, formed with notches 20, to engage nails, for example nails 14, 15, 24, 25. The rearward portion 21 of blade 19 is angled towards the handle 28 which is usually, approximately, about 4 feet long, and attached to the blade 19 at, generally, a mid-point thereof. The rear portion 21 of the blade 19 also is attached to the handle 28. The rearmost part of the handle 28 carries a hand or finger guard 29.

If the tool 18 is placed between the roofing paper 11 and the first course of underlay and shingles 12, 13, so that the blade 20 engages beneath the underlay and shingles, with the notches 20 engaging around a nail below its head, the tool can be used to pry up the nails holding the course of shingles. It can readily be seen that the stresses placed on the blade 19 between the attachment point 30 of the handle and the forward end, that is the notch region of the tool, are considerable and will tend to deform or bend the tool blade. The rear support portion 21 only provides for an angled position of the blade when the roofer is working along a flat portion of the roof so that the heel bend 31 of the tool can be used as a prying fulcrum. The stresses placed on the blade ahead of the attachment point 30, however, will not be changed, nor will the upwardly extending rear support portion 21 provide for force transfer to pry up a nail.

If a nail is gripped which is located at an outer edge notch of the tool, a torque will be transferred to the operator. To pry up such a nail, it is necessary to either reposition the tool or twist the tool 18 over a side thereof while continuing to pry up on the handle, which requires the roofer to exert an unbalanced force, and additionally tends to bend the tool. In actual practice, it is frequently necessary to re-hammer such a tool back into shape, with the blade 19 flat and as shown in the figures. This requires interruption of shingle removal, and which can be done only up to a point until the tool breaks or is permanently deformed.

In accordance with a feature of the present invention, the tool blade is re-configured, the notches are placed differently with respect to the handle, and the support portion of the tool blade, with respect to the notches, likewise, is relocated.

Figure 2A:
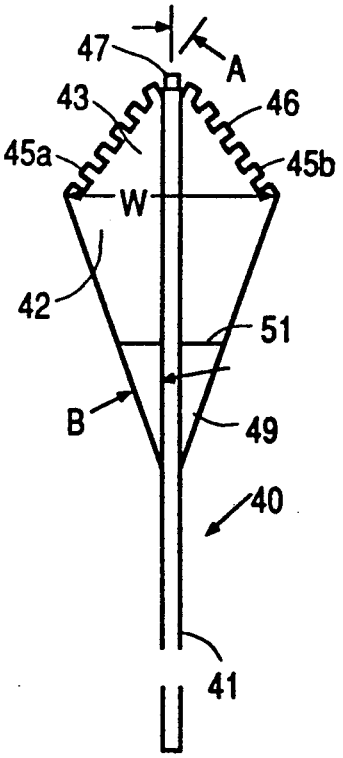
Figure 2B:
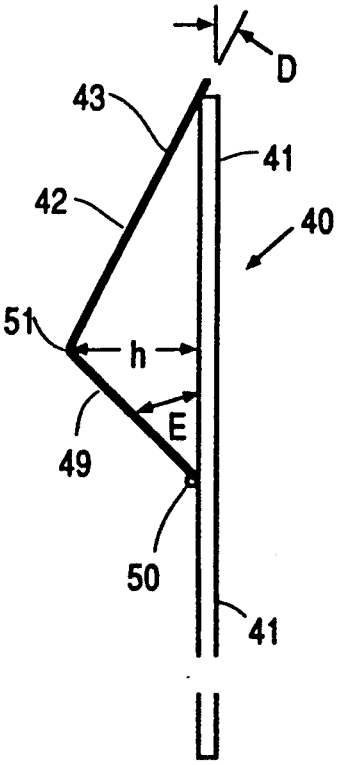
Figure 3:
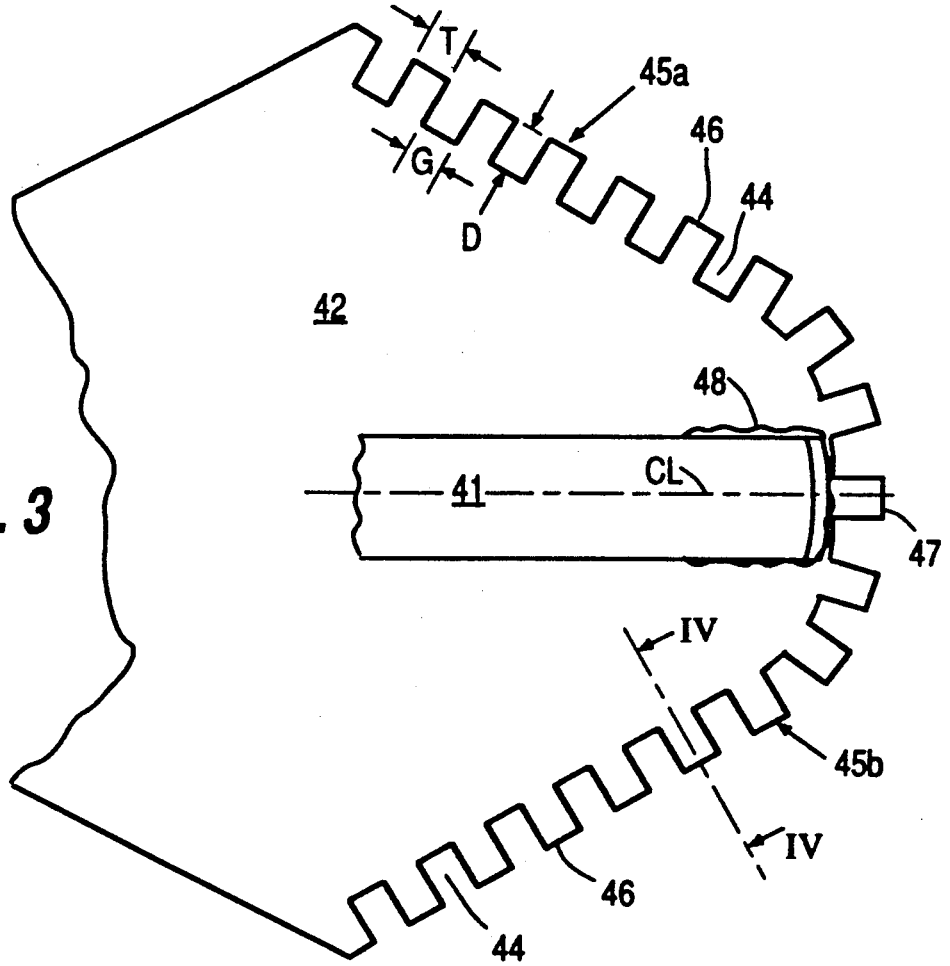
FIG. 3 is a greatly enlarged top view of the forward portion of the prying blade, which, in the original drawings, is approximately to the size of a preferred embodiment.

Referring now to FIGS. 2*a*, 2*b* and 3:

The tool 40, in accordance with the present invention, has a handle 41 and a blade 42. The blade 42 has an essentially triangular forward portion 43, with notches 44 formed along the side edges 45*a*, 45*b* of the triangular forward portion 43. The notches 44, which can be punched, ground, cut or otherwise formed in the side edges, leave intermediate teeth 46. The general aspect, looked at in plan view, of the blade 42 is approximately triangular, with an apex region 47 which is rounded, as best seen in FIG. 3.

In accordance with a feature of the invention, the handle 41 is attached to the blade 42 as close to the forward edge of the tool as possible, for example by being welded at the apex region 47, see FIG. 3, by a forward weld connection 48.

An adjoining portion of the blade, narrowing from the widest points of the essentially triangular forward portion of the blade 42, is continued in the same plane, to be then angled away to form a support portion 49. The angle between the forward portion and the support portion defines a ridge or heel or bend line 51. The free end of the support portion 49 is secured to the handle 41 in a suitable manner, for example by a weld 50.

Figure 4:
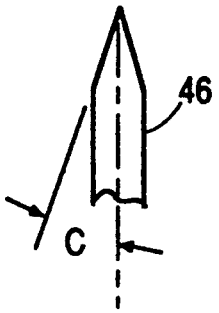
FIG. 4 is a sectional view along section IV—IV of FIG. 3.
Figure 6:
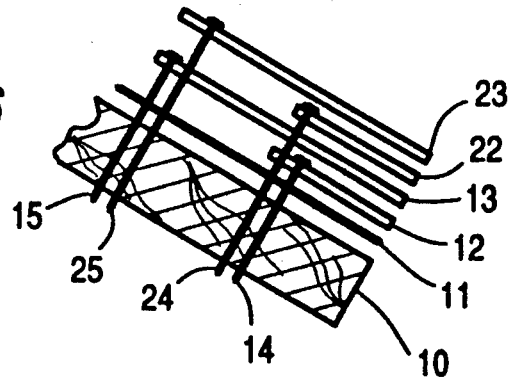
FIG. 6 is an exploded fragmentary view of a roof structure.

The blade 42 is made of a strong steel, for example of cold-rolled 10-gauge steel, or high-carbon cold-rolled steel or similar strong material. The teeth 46, see FIG. 4, are preferably tapered from both sides of the blade towards an essentially centrally positioned plane, to form a double-bevel of a angle C (FIG. 4). Suitable approximate dimensions and angles, for a preferred form of the tool to pull 2½" roofing nails, are:

angle A: 40°±5°
angle B: 15°–20°
angle C: 10°–20°
angle D: 20°–25°, preferably 22°–23°
angle E: 38°
width T of teeth 46: ¼";
width of notches 44: ¼";
length of triangular notched sides 45*a*, 45*b*: 5";
length of support portion 49: 4";
height h between heel ridge 51 and handle 41: 2½";
handle 41: 1" outer diameter (OD) seamless pipe 4 ft. long;
width w of blade 42 at widest point: 6½".
blade thickness: about 3/16.

None of the foregoing dimensions or angles are critical; they have been found, in actual practice, to be eminently suitable and are preferred.

Figure 5:
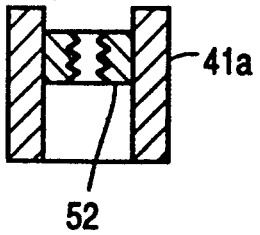
FIG. 5 is a fragmentary sectional view of the end of the handle.

For some installations, for example to remove shingles from projecting dormers, it may be necessary to extend the tool so that the roofer can reach shingles without actually climbing on a dormer. In accordance with a feature of the invention, the end portion 41*a* (FIG. 5) of the handle has a threaded plug 52 secured in a recess of the handle therein, for example by welding or the like, or by heat shrinking. The reason for the recess of the plug 52 is this: To get between tightly nailed shingles and the roof structure 10, it may be necessary to hammer the tool between the shingles and the roof structure. Applying blows against the end portion 41 may deform the end portion and if the tool were threaded at the end, the threads, likewise, would be damaged. Recessing a threaded plug 52 inwardly of the end portion permits attachment of an extension handle with a projecting threaded bolt, which can be screwed tight against the end portion 41*a* and, if necessary, secured additionally by an outer sleeve fitted over the end portion 41*a* and over an end of such an extension handle.

The end portion 41*a* of the handle 41 can be fitted with a hand and finger guard 29, omitted from FIG. 2*b* for clarity of the illustration.

In use, the teeth 46 between the notches 44 may wear. It is possible to form the blade 42 as a two-element structure by forming the blade as a solid blade part with the regions of the notches as a separate strip, the solid blade part and the strip then being welded together. The strips can be replacement strips, to be cut off by a cut-off welding torch when they are worn, and re-welded with a replacement strip.

Alternatively, if the blade is worn, it can be severed from the handle by melting-back the weld 48 and severing the weld 50 at the support portion, and re-welding the handle to a new blade, the used blade then being recycled for re-manufacture into steel. Other attachments than welding, if of sufficient strength, may be used.

USE OF THE TOOL

The diamond shape of the operating or forward portion 43 of the blade 42, with the teeth and notches 46, 44 at the front and the sides, and the snub nose, permits wedging up of nails both at the front as well as at the sides. Only the nail gripping teeth on the blade project beyond a supported surface, hence there is no blade region, which can deform. Even the two or three forward teeth are supported immediately at their roots. The tool is inserted between the roofing paper or felt 11 and the lowermost course of shingles, working downwardly from a roof, i.e. the shingles 13. At the end, the tool is pushed beneath underlay 12. The double bevel, see FIG. 3, protects the roofing paper from engagement with the forward portion of the teeth, and hence damage to the roofing paper; the upper bevel permits easy slipping underneath the first layer of shingles. Regardless of where a nail may be—in line with the center line CL, or along the sides, the tool can be tipped over the heel 51 to pry up a nail. Even if only one nail should be at an outer region of the blade—which is unlikely—the tool need not be tipped sideways to raise it completely and to pry it out of the roofing substructure 10 together with the shingle. If the nail should have gone not only into the roof structure 10 but also, for example, into a rafter, it can hold very tightly. The long handle, together with the leverage available upon tipping the handle about the heel 51, can reliably pry out also such nails, even if they are embedded in the first layer 13 of shingles, requiring raising that shingle together with a nailed second layer 23 of shingles. The triangular construction of the blade eliminates lateral twisting. The substantially greater angle D of the blade 42 between the handle, resulting in a substantially greater height h at the heel, with respect to the prior art, permits reliable raising and prying of roofing nails of all customarily used lengths, without re-gripping of any nail which is once caught in a groove 44. The nail heads, typically, have diameters greater than ¼", so that they are held between two teeth and will not have the tendency to slip between notches, with deformed heads, which, in the tools of the prior art, requires re-positioning of the tool and, in effect, double work to remove one nail. In actual experience, it has been found that the tool of the present invention permits removal of about twice as much shingled roof surface in a given time with respect to the use of prior art prying bars, without damage, deformation, or bending of the tool itself.

Various changes and modifications may be made, and any features described herein may be used with any of the others, within the scope of the inventive concept.

I claim:

1. Roofing shingle removal tool comprising
a handle (41);
a prying blade (42) having
an essentially triangular, substantially flat forward portion (43) defining an apex region (47) and two lateral sides (45*a*, 45*b*);
nail receiving notches (44) formed in said lateral sides and defining teeth (46) therebetween, and
a rear support portion (49) extending from the forward portion;
first attachment means (48) for attaching said forward portion to said handle immediately adjacent the apex region, and for retaining the forward portion with respect to said handle at a first angle (D); and
second attachment means (50) for attaching said rear support portion to said handle at a position remote from said first attachment means,
said blade defining a bend or heel (51) between said forward portion and said support portion, which bend or heel or ridge line (51) is spaced from said handle by a predetermined distance (h).

2. The tool of claim 1, wherein said apex region (47) forms a blunt or rounded region of the blade;
and nail receiving notches (44) are formed in said blunt or rounded region.

3. The tool of claim 1, wherein said apex region (47) forms a blunt or rounded region of the blade; and
said first attachment means (48) attach said handle (41) immediately adjacent said blunt or rounded region.

4. The tool of claim 2, wherein said blunt or rounded region extends between said lateral sides (45*a*, 45*b*) for a distance corresponding substantially to the width of the handle (41).

5. The tool of claim 3, wherein said blunt or rounded region extends between said lateral sides (45*a*, 45*b*) for a distance corresponding substantially to the width of the handle (41).

6. The tool of claim 1, wherein said handle (41) comprises a pipe element.

7. The tool of claim 6, wherein the handle (41) has an end portion (41*a*) remote from said first attachment means, said end portion including a threaded element (52) recessed inwardly in said pipe element to permit deformation of the end portion (41*a*) of the pipe element without damage to the threaded element (52).

8. The tool of claim 1, wherein said essentially triangular forward portion (43) includes an angle of between about 70°–90°.

9. The tool of claim 1, wherein said predetermined distance (h) is about 2½" (6½ cm).

10. The tool of claim 1, wherein said first angle (D) is between about 20°–25°.

11. The tool of claim 10, wherein said first angle (D) is between about 22°–23°.

12. The tool of claim 1, wherein said teeth (46) are formed with a double bevel, each bevel having a bevel angle (C) of between about 10°–20°.

13. The tool of claim 1, wherein said blade (42) has a width (w) between said sides (45*a*, 45*b*) remote from said apex in the order of between about 5–8" (12.5–20 cm).

14. The tool of claim 13, wherein said width (w) is about 6½" (16.5 cm).

15. The tool of claim 1, wherein said teeth have a width of about ¼" (6 mm).

16. The tool of claim 1, wherein said notches (44) have a depth (D) of about ¼" (6 mm).

* * * * *